United States Patent [19]

Thorsen

[11] 4,082,929

[45] Apr. 4, 1978

[54] ELECTRIC SWITCH ACTUATED IN DEPENDENCE ON PRESSURE, PARTICULARLY AN EVAPORATOR THERMOSTAT FOR REFRIGERATORS

[75] Inventor: Niels Peter Thorsen, Sonderborg, Germany

[73] Assignee: Danfoss A/S, Nordborg, Denmark

[21] Appl. No.: 715,123

[22] Filed: Aug. 17, 1976

[30] Foreign Application Priority Data

Aug. 12, 1975 Germany ..... 2535874

[51] Int. Cl.[2] ..... H01C 35/32

[52] U.S. Cl. ..... 200/83 SA; 200/81 R; 200/83 S; 200/83 C; 337/117

[58] Field of Search ..... 337/115, 117, 317, 320; 200/153 T, 330, 81 R, 290, 83 C, 83 D, 83 S, 83 SA, 83 P

[56] References Cited

U.S. PATENT DOCUMENTS

| | | | |
|---|---|---|---|
| 2,480,538 | 8/1949 | Barr | 200/83 SA |
| 3,256,398 | 6/1966 | Snider | 200/81 R |
| 3,319,023 | 5/1967 | Lake | 200/81 R |

*Primary Examiner*—Gerald P. Tolin

[57] ABSTRACT

The invention relates to an electric switch assembly of the type operated by a thermostatic bellows, for use on refrigerators. The operating bellows is part of a system having a liquid/vapor filling and the movement of the bellows operates a microswitch. A hinged arm which operates the microswitch is biased in a switch closing direction by the bellows and in a switch opening direction by a spring system which includes a main spring and a differential spring in series. The force displacement line of the spring system approximates the force displacement line of the bellows and has two segments with different slopes. The two segments are formed by arresting the movement of the differential spring to make it ineffective at an intermediate point in the displacement of the bellows. The first segment with a lesser slope represents the action of both springs in series while the other segment, of greater slope, represents only the main spring. Adjustments are provided for the spring system to control the temperatures at which the microswitch contacts close and open.

3 Claims, 3 Drawing Figures

Figure 1:
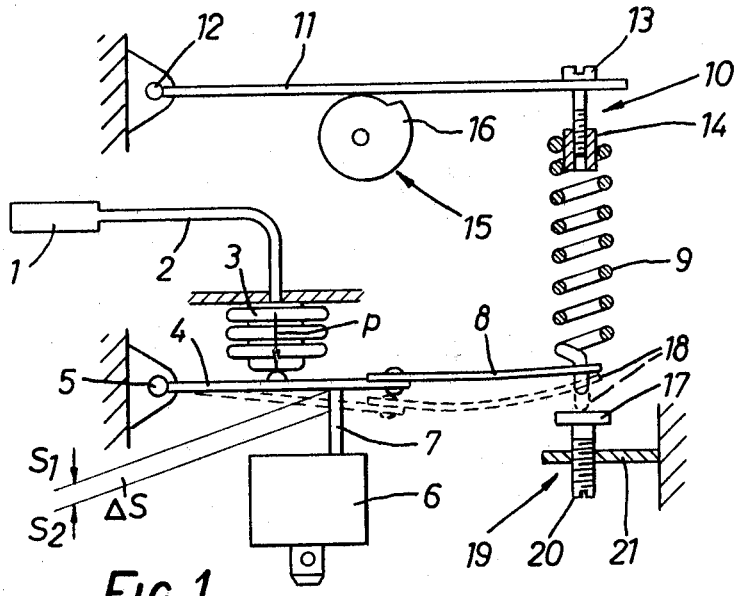

ELECTRIC SWITCH ACTUATED IN DEPENDENCE ON PRESSURE, PARTICULARLY AN EVAPORATOR THERMOSTAT FOR REFRIGERATORS

The invention relates to an electric switch actuated in dependence on pressure, particularly an evaporator thermostat for refrigerators, in which the actuating element is held in a position of force equilibrium under the influence of a pressure transmitter, e.g. the operating bellows of a thermostatic system filled with fluid/-vapour, a main spring, and a differential spring which is to be made ineffective by an abutment, and in which the actuating element is effective in a first switching position to switch over in one direction and in a second switching position to switch over in the other direction, the prestressing of the main spring being adjustable by means of first adjusting means to set the first switching position and the prestressing of the differential spring being adjustable with the aid of setting means for varying the second switching position within a predetermined range as well as with the aid of second adjusting means to set this range.

An evaporator thermostat is known, in which a first swing arm for actuating a microswitch engages on the one hand the operating element of a thermostatic system and on the other hand the main spring. The other end of the main spring is suspended with the aid of an adjusting screw to a holder that is fixed with respect to the housing. A second swing arm is loaded by the differential spring and acts by way of a pressure rod in the same direction as the operating element acts on the first swing arm. The second swing arm carries an adjustable abutment co-operating with a counterbearing fixed with respect to the housing. The differential spring has one end connected by way of an adjusting screw to the second swing arm and has its other end suspended from a third swing arm which is adjustable with the aid of a setting cam. On exceeding a predetermined first temperature, corresponding to the first switching position, the contacts of the microswitch close and on falling below a second temperature corresponding to the second switching position these contacts open.

In this evaporator thermostat, the main spring is to act on the first swing arm alone in the case of the first switching position whilst in the second switching position the differential spring is to act on the first swing arm parallel to the main spring but in the opposite sense. With the aid of the adjusting screw of the main spring, the closing temperature can then be set at will and with the aid of the adjusting screw of the differential spring one can set the range of the opening temperature that is to be traversed with the aid of the setting means. However, the adjustable abutment on the second swing arm must in addition be adjusted so that it makes the differential spring ineffective precisely between the closing temperature and the opening temperature. By reason of the three adjusting means, the three swing arms and the pressure rod, a considerably expensive construction is obtained. The adjustment of three devices requires a corresponding amount of time.

The invention is based on the object of providing a pressure-governed electric switch of the aforementioned kind which is simpler in construction and can be adjusted more simply.

This object is achieved by the invention in that the main spring and the differential spring are connected in series and the first adjusting means also form the abutment for the differential spring.

Since the differential spring exerts its force on the actuating element through the main spring, the hitherto essential transmission elements between the differential spring and the actuating element are omitted. Further, only two adjusting means are now necessary because the first adjusting means are combined with the abutment for the differential spring. This results in a considerably simplified construction and more rapid adjustment. The stability and mechanical life are increased because the number of friction points is reduced. A particular advantage is obtained in conjunction with a thermostatic system with fluid/vapour filling in which the vapour pressure curves for elevated temperatures are steeper than for lower temperatures. This is because the force-displacement diagram for the new switch has a bent course in which there is a shallower inclination in the range of lower pressures and a steeper inclination in the range of higher pressures. The connection between temperature variation and setting of the actuating element is therefore more closely linear than hitherto and, above all, exhibits no sharp changes.

Preferably, the force-displacement characteristic line of the differential spring is at most as steep as that of the main spring. The angle of inclination of the force-displacement characteristic line of the series connection for the main spring and differential spring is therefore less than half the angle of inclination of the force-displacement characteristic line for the main spring. The larger the differences in inclination, the greater is the possibility in a predetermined range of the setting means to vary the pressures required for the first and second switching position by adjusting the two adjusting means.

A particularly simple construction is obtained if the first adjusting means are provided adjacent the coupling between the main and differential springs and co-operate directly with one of the springs. One then dispenses with an abutment movable together with the differential spring.

If the main spring is a leaf spring extending at right-angles to the differential spring which is in the form of a tension spring, a compact construction is obtained.

In particular, one can ensure that the leaf spring is disposed as an extension of a first swing arm which actuates a snap switch, e.g. a microswitch, and is loaded by the pressure transmitter, that a second swing arm extends parallel thereto and is engaged by the setting means, that the differential spring is connected on the one hand to the second swing arm with the interpositioning of the second adjusting means and on the other hand to the leaf spring, and that the first adjusting means are adjacent the leaf spring or a part connected thereto. This saves still further space.

Figure 2:
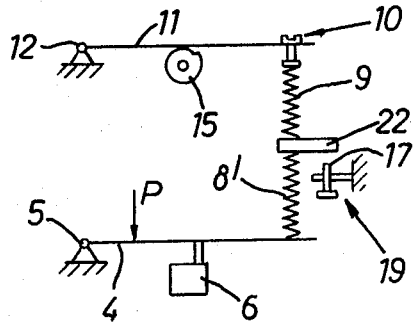

The invention will now be described in more detail with reference to the drawing showing examples. In the drawings:

FIG. 1 represents one example of a switch according to the invention,

FIG. 2 diagrammatically illustrates a further embodiment, and

Figure 3:
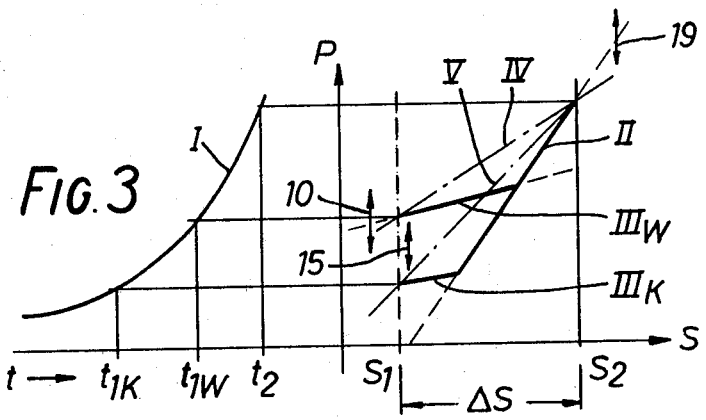

FIG. 3 is a diagram showing the relationship between the measured temperature *t*, the occurring pressures P and the path *s* of the actuating element.

FIG. 1 illustrates an evaporator thermostat for refrigerators. A senser 1 with a fluid/vapour filling is connected by a capillary tube 2 to an operating element 3.

The latter acts on a first swing arm 4 which is pivotably mounted by means of a hinge 5. It is the actuating element for a microswitch 6 of which the push member 7 is displaceable by the first swing arm 4. Also connected to the first swing arm 4 there is a main spring 8 in the form of a leaf spring. A differential spring 9 in the form of a coil spring extends at right-angles to it and has one end suspended from the main spring 8 whilst the other end is connected by way of adjusting means 10 to a second swing arm 11 having a bearing 12 fixed with respect to the housing. The adjusting means 10 consist of a screw 13 and an associated nut 14 on which the end of the differential spring 9 is placed. Setting means 15 engage the second swing arm 11 by means of a cam plate 16. In addition, an abutment face 17 is provided against which the lower end 18 of the differential spring 9 can bear. This abutment face is part of adjusting means 19 comprising a screw 20 in a stationary holder 21 which carries the abutment face 17.

The microswitch 6 operates when the push member 7 exceeds the switching position $s_1$ upwardly and the switching position $s_2$ downwardly. For switching over, the first swing arm 4 must therefore traverse a path $\Delta s$.

The operation of this thermostat will now be described in conjunction with FIG. 3. That figure shows the pressure P to the left above the temperature $t$ of the senser 1 and to the right above the path $s$ of the push member 7. The vapour curve I applicable for the thermostatic system 1, 2, 3 is entered at the left. The force-displacement characteristic line II of the main spring 8 and the force-displacement characteristic line III of the series connected main spring 8 and differential spring 9 are shown at the right, the characteristic line III$w$ being applicable to a switching point at elevated temperature and the characteristic line III$k$ being applicable to a switching point of lower temperature. The transition of line II to line III takes place when the end 18 of the spring strikes the abutment 17. In the position shown in full lines in FIG. 1, the series connection is ineffective, and thus the line III applies. When the abutment 17 is reached, as shown in broken lines in FIG. 1, only the main spring 8 will be effective and therefore the characteristic line II applies.

In such a thermostat, the first switching temperature $t_2$ is fixed whilst the second switching temperature can be varied between a higher value $t_{1w}$ and a lower value $t_{1k}$ with the aid of the setting means 15. To set the first switching temperature $t_2$, one actuates the adjusting means 19. The latter permit the prestress of the main spring 8 to be varied at that section at which this main spring is alone effective. By setting the adjusting means 19, therefore, the characteristic line II is displaced vertically. This leads to a change in the first switching temperature $t_2$.

To determine the temperature range that can be covered by the setting means 15, the adjusting means 10 are used. It is with their aid that the prestress of the differential spring 9 and thus the prestress of the series connection can be changed. Actuation of the adjusting means 10 therefore leads to a displacement of the characteristic line III in the vertical direction. This displaces the temperature range between the second switching temperatures $t_{1w}$ and $t_{1k}$ together.

It will be seen that the adjusting means 10 and 19 can be adjusted over considerable values without changing anything in the manner of operation. With a fixed first switching temperature $t_2$, the characteristic lines III can be displaced through a considerable portion of the height of the diagram. Similarly, the characteristic line II can be displaced a considerable distance downwardly and upwardly.

A limit of the choice of the characteristic lines of the springs is reached only when the inclination of the line III becomes steeper than the inclination of a connecting line IV or when the inclination of the line II becomes flatter than the inclination of a connecting line V. The connecting lines IV and V connect the switching point corresponding to the first switching temperature $t_2$ to the switching points corresponding to the higher second switching temperature $t_{1w}$ or the lower second switching temperature $t_{1k}$. It is therefore advisable to give the differential spring 9 as low an inclination as possible so that the differences in the inclinations of the characteristic lines II and III are correspondingly large.

FIG. 3 further shows that the effective branches of the lines II and III have a course approximating to that of the vapour pressure curve I.

In the embodiment according to FIG. 2, the same parts are referenced with the same reference numerals as in FIG. 1. Accordingly, the only difference is the use of a main spring 8' in the form of a coil spring suspended with one end at the swing arm 4 and having at the other end a coupling member 22 common to the differential spring 9. This coupling member co-operates with the adjusting means 19 and its abutment 17.

The main spring and differential spring can also be compression springs or one can be a compression spring and the other a tension spring. Further, other spring constructions are feasible, e.g. leaf springs or the like bent to an angle.

I claim:

1. An electric assembly of the type operated by a thermostatic bellows, comprising, a hinged swing arm, a microswitch having a displaceable operating element attached to said arm for movement therewith, said operating element having a first position for closing and a second position for opening the contacts of said microswitch, spring means including a main spring and a differential spring in series connected at one end to said swing arm and at the other end to adjustable anchor means, said bellows biasing said swing arm in a switch closing direction and said spring means biasing said swing arm in a switch opening direction, abutment means for arresting the movement of said differential spring at a set point when said operating element is at a corresponding point between its said closing and opening positions, first adjustment means on said abutment means for adjusting the arresting point of said differential spring to adjust said closing position of said microswitch, and second adjustment means for said anchor means to adjust the stress of said spring means to adjust said opening position of said microswitch.

2. An electric switch assembly according to claim 1 wherein the force displacement line of said spring means approximates the force displacement line of said bellows and has first and second segments with different slopes, said first segment being of lesser slope and representing the action of both said springs in series, said second segment being of greater slope and representing only said main spring.

3. An electric switch assembly according to claim 2 wherein said main spring is a leaf spring extending from said swing arm and said differential spring is a coil spring, said first adjustment means being in close proximity to the junction of said main and differential springs.

* * * * *